US008640590B2

(12) United States Patent
Holowczak et al.

(10) Patent No.: US 8,640,590 B2
(45) Date of Patent: Feb. 4, 2014

(54) ARMOR SYSTEM HAVING CERAMIC COMPOSITE WITH IMPROVED ARCHITECTURE

(75) Inventors: John E. Holowczak, South Windsor, CT (US); William K. Tredway, Manchester, CT (US); Robert A. Barth, South Windsor, CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 1155 days.

(21) Appl. No.: 12/100,528

(22) Filed: Apr. 10, 2008

(65) Prior Publication Data

US 2012/0174751 A1 Jul. 12, 2012

Related U.S. Application Data

(63) Continuation-in-part of application No. 11/682,390, filed on Mar. 6, 2007.

(60) Provisional application No. 60/794,276, filed on Apr. 20, 2006.

(51) Int. Cl.
*F41H 5/02* (2006.01)

(52) U.S. Cl.
USPC ..... 89/36.02; 89/36.08; 89/36.01; 89/36.11; 89/36.05

(58) Field of Classification Search
USPC ..... 89/36.01, 36.02, 36.04, 36.07, 36.08, 89/36.05, 36.11
See application file for complete search history.

(56) References Cited

U.S. PATENT DOCUMENTS

| | | | | |
|---|---|---|---|---|
| 3,828,699 | A * | 8/1974 | Bowen | 109/80 |
| 4,719,151 | A * | 1/1988 | Chyung et al. | 428/428 |
| 6,575,075 | B2 * | 6/2003 | Cohen | 89/36.02 |
| 7,238,414 | B2 | 7/2007 | Benitsch et al. | |

FOREIGN PATENT DOCUMENTS

| | | |
|---|---|---|
| EP | 1538417 A1 | 6/2005 |
| FR | 2723193 | 2/1996 |

OTHER PUBLICATIONS

WO 030010484, Feb. 2003, Ace-Ram Technologies.*
European Search Report for European Patent Application No. 09005121.0 completed Apr. 23, 2013.

* cited by examiner

*Primary Examiner* — J. Woodow Eldred
(74) *Attorney, Agent, or Firm* — Carlson, Gaskey & Olds, P.C.

(57) ABSTRACT

An armor system includes a ceramic armor layer and a ceramic composite armor layer adjacent to the ceramic armor layer. The ceramic composite armor layer includes a ceramic matrix and unidirectionally oriented fibers disposed within the ceramic matrix.

15 Claims, 5 Drawing Sheets

ARMOR SYSTEM HAVING CERAMIC COMPOSITE WITH IMPROVED ARCHITECTURE

CROSS REFERENCE TO RELATED APPLICATIONS

This application is a continuation-in-part of U.S. application Ser. No. 11/682,390, filed Mar. 6, 2007, claiming priority to U.S. Provisional Application No. 60/794,276, filed Apr. 20, 2006.

BACKGROUND OF THE INVENTION

This disclosure relates to an armor system and, more particularly, to an armor system having multiple ceramic layers and a method for manufacturing the armor system.

A variety of configurations of projectile resistant armor are known. Some are used on vehicles while others are specifically intended to protect an individual. Some materials or material combinations have proven useful for both applications. However, there is a continuing need to provide relatively lightweight armor systems and methods of manufacturing armor systems that are useful in a variety of different applications.

SUMMARY OF THE INVENTION

In disclosed embodiments, an armor system includes a ceramic armor layer and a ceramic composite layer adjacent the ceramic armor layer. The ceramic composite armor layer includes a ceramic matrix and unidirectionally oriented fibers disposed within the ceramic matrix.

The ceramic composite armor layer may include a plurality of sublayers each having a ceramic matrix and unidirectionally oriented fibers disposed within the ceramic matrix. At least one of the plurality of sublayers may have a different orientation than another of the sublayers relative to the unidirectionally oriented fibers.

An example method of manufacturing the armor system includes forming a ceramic composite armor layer on a prefabricated armor layer. For instance, pre-impregnated unidirectional tape may be used to form the ceramic composite armor layer.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
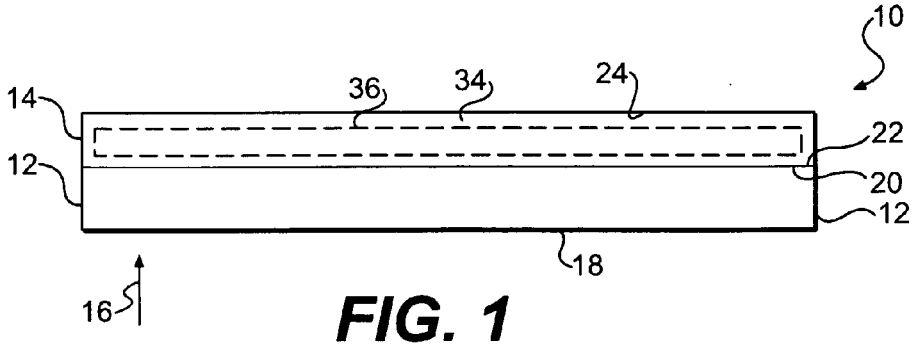
FIG. 1 illustrates an example armor system.

FIG. 1 illustrates a portion of an example armor system 10 for resisting impact of a ballistic projectile. The armor system 10 may be utilized in a variety of different applications for defeating ballistics, such as, but not limited to, armor piercing projectiles at or near muzzle velocity. For example, the armor system 10 includes an aerial density that is at least equal to or lighter than known armor systems and may be used as a plate or panel in a personal body armor vest or vehicle.

The armor system 10 is a multilayer structure that includes a ceramic armor layer 12 and a ceramic composite armor layer 14. It is to be understood that the ceramic armor layer 12 and ceramic composite armor layer 14 may also be used in combination with other armor layers, depending upon a particular design and intended use. The ceramic armor layer 12 and ceramic composite armor layer 14 may be any desired thickness or shape for resisting a ballistic impact. For example, the ceramic armor layer 12 and ceramic composite armor layer 14 may be between several hundredths of an inch thick and several inches thick, depending upon a particular design and intended use of the armor system 10.

The ceramic armor layer 12 and the ceramic composite armor layer 14 are arranged relative to an expected projectile direction 16. The ceramic armor layer 12 includes a projectile strike face 18 for initially receiving a projectile. A back face 20 of the armor layer 12 is bonded to the ceramic composite armor layer 14. Thus, the ceramic armor layer 12 and the ceramic composite armor layer 14 are directly bonded to one another, as will be described below, and need not include any layers of adhesive that would add thickness and/or diminish the ballistic impact performance of the armor system 10.

Using ceramic materials for the ceramic armor layer 12 and the ceramic composite armor layer 14 provides a relatively close sound impedance match. Sound impedance refers to the speed of sound through the ceramic materials. For example, an impact between a projectile and the projectile strike face 18 of the ceramic armor layer 12 causes compressive stress waves to move through the ceramic armor layer 12 toward the back face 20. At least a portion of the compressive stress wave reflects off of a front face 22 of the ceramic composite armor layer 14 as a tensile stress wave. A second portion of the compressive stress wave travels through the ceramic composite armor layer 14 and reflects off of a rear face 24 of the ceramic composite armor layer 14. The tensile stress waves destructively interfere with the compressive stress waves, which reduces the total stress within at least the ceramic armor layer 12 to thereby facilitate energy absorption of the armor system 10.

The impedance of the ceramic material of the ceramic composite armor layer 14 facilitates efficient and quick reflection of the compressive stress waves. That is, the ceramic matrix material reflects relatively larger portions of the compressive stress waves over a relatively shorter period of time compared to polymeric-based materials. Depending on the ceramic materials selected, the impedance of each of the ceramic armor layer 12 and the ceramic composite armor layer 14 may be in the range of $10–40\times10^6$ kilograms per square meter seconds ($kg\text{-}m^{-2}\text{-}s^{-1}$). In a further example, the impedance may be in the range of about $25–35\times10^6$ $kg\text{-}m^{-2}\text{-}s^{-1}$.

Figure 2:
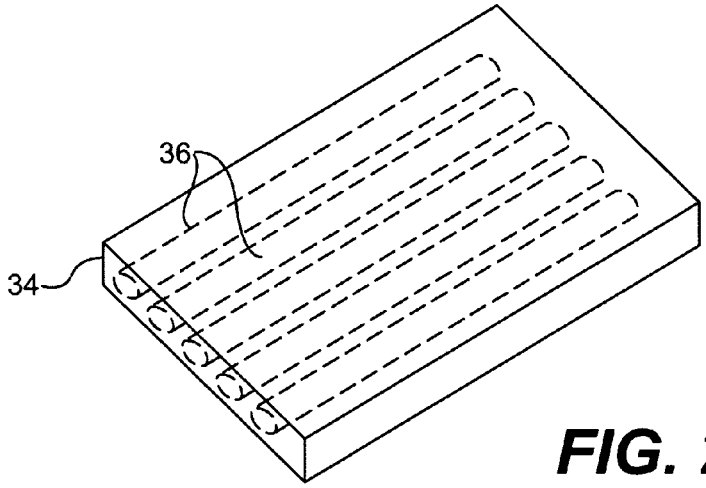
FIG. 2 illustrates a portion of an example ceramic composite armor layer having unidirectionally oriented fibers disposed within a ceramic matrix.

In the disclosed embodiment, the ceramic armor layer 12 is a monolithic ceramic material and the ceramic composite armor layer 14 is a composite. FIG. 2 illustrates a perspective view of the ceramic composite armor layer 14, which includes a ceramic matrix 34 and unidirectionally oriented fibers 36 disposed within the ceramic matrix 34. That is, the unidirectionally oriented fibers 36 are substantially parallel and coplanar. The term "substantially" as used in this description relative to geometry refers to possible variation in the given geometry, such as typical manufacturing variation.

The monolithic ceramic material of the ceramic armor layer 12 initially receives a ballistic projectile and absorbs a portion of the energy associated with the ballistic projectile through fracture and stress wave cancellation as described above. The composite of the ceramic composite armor layer 14 reflects a portion of the stress waves as discussed above and absorbs a portion of the energy associated with the ballistic projectile through fiber debinding and pullout, as well as shear failure. The composite also facilitates reduction in the degree of fragmentation of the monolithic ceramic material compared to conventional backing materials.

In the disclosed examples, the unidirectionally oriented fibers 36 facilitate energy absorption and reflection of stress waves due to the ballistic impact. For example, during a ballistic event, interwoven fibers that are bent around each other must first straighten out prior to stiffening and absorbing energy. The time that it takes for the bent fibers to straighten may increase the reaction time in a ballistic event. However, the unidirectionally oriented fibers 36 are already straight and therefore do not require additional time for straightening as do interwoven fibers. Thus, using the unidirectionally oriented fibers 36 facilitates reduction of the reaction time of the ceramic armor composite layer 14 or in a ballistic event.

As will now be described, the monolithic ceramic material of the ceramic armor layer 12 and the ceramic matrix 34 and unidirectionally oriented fibers 36 of the ceramic composite armor layer 14 may include a variety of different types of materials, which may be selected depending on a particular intended use. The monolithic ceramic material may be, for example only, silicon nitride, silicon aluminum oxynitride, silicon carbide, silicon oxynitride, aluminum nitride, aluminum oxide, hafnium oxide, zirconia, siliconized silicon carbide, or boron carbide. The term "monolithic" as used in this disclosure refers to a single material; however, the single material may include impurities that do not affect the properties of the material, elements that are unmeasured or undetectable in the material, or additives (e.g., processing agents). However, in other examples, the monolithic material may be pure and free of impurities. Given this description, one of ordinary skill in the art will understand that other oxides, carbides, nitrides, or other types of ceramics may be used to suit a particular need.

Likewise, the ceramic matrix 34 and unidirectionally oriented fibers 36 may be selected from a variety of different types of materials. For example only, the unidirectionally oriented fibers 36 may be silicon carbide fibers, silicon nitride fibers, silicon-oxygen-carbon fibers, silicon-nitrogen-oxygen-carbon fibers, aluminum oxide fibers, silicon aluminum oxynitride fibers, aluminum nitride fibers, or carbon fibers. In some examples, the unidirectionally reinforced fibers 36 include fibers of NICALON®, SYLRAMIC®, TYRANNO®, HPZ™, pitch derived carbon, or polyacronitrile derived carbon, fibers.

The ceramic matrix 34 may include a silicate glass material, such as magnesium aluminum silicate, magnesium barium silicate, lithium aluminum silicate, borosilicate, or barium aluminum silicate. Given this description, one of ordinary skill in the art will understand that other types of fibers and matrix materials may be used to suit a particular need.

Figure 3:
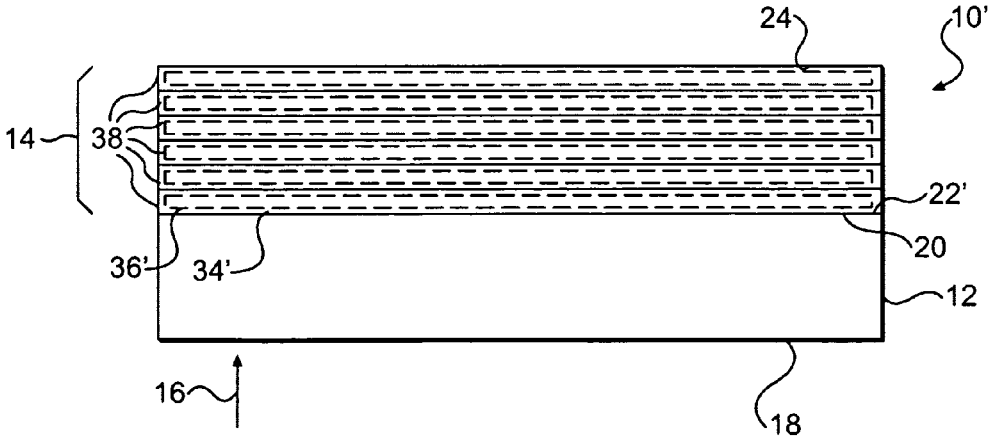
FIG. 3 illustrates another example armor system.

As can be appreciated, the ceramic composite armor layer 14 of FIG. 2 is a single layer. In another embodiment illustrated in FIG. 3, like elements are represented with like reference numerals and modified elements are represented with the addition of a prime symbol. In this embodiment, an armor system 10' includes a ceramic composite armor layer 14' having a plurality of sublayers 38. Each of the sublayers 38 includes unidirectionally oriented fibers 36' disposed within a matrix 34', similar to the single layer of the ceramic composite armor layer 14 of the previous example. Using multiple sublayers 38 may facilitate even greater energy absorption.

Figure 4:
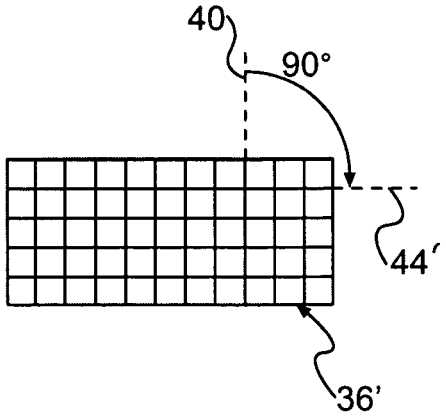
FIG. 4 illustrates a 0°/45°/90° ceramic composite armor layer.

Each of the sublayers 38 may have an associated orientation relative to the unidirectionally oriented fibers 36' of the respective sublayer 38. In this regard, the unidirectionally oriented fibers 36' of the sublayers 38 may be arranged with different orientations to facilitate uniform energy absorption and reflection, for example. For instance, for illustrative purposes only, FIG. 4 illustrates only the unidirectionally oriented fibers 36' of two of the sublayers 38. Unidirectionally oriented fibers 36' of one of the sublayers 38 are oriented in a 0° orientation as represented by axis 40 and unidirectionally oriented fibers 36' of another of the sublayers 38 are oriented 90° as represented by axis 44 relative to the 0° orientation 40. That is, the sublayers 38 provide a 0°/90° arrangement. As can be appreciated, the other sublayers 38 may be likewise oriented.

In the disclosed example, six of the sublayers 38 are used; however, fewer or more sublayers 38 may be used. In the disclosed example, the combination of the six sublayers 38 oriented 0°/90°/0°/90°/0°/90° is capable of facilitating stopping an armor piercing ballistic with a measured velocity of 2884 feet per second (879 meters per second) when packaged with a front spall shield of three layers of carbon reinforced epoxy and a backing layer of 0.3 inch (0.76 cm) of a unidirectionally aligned compressed polyethyelene fiber layer.

Figure 5:
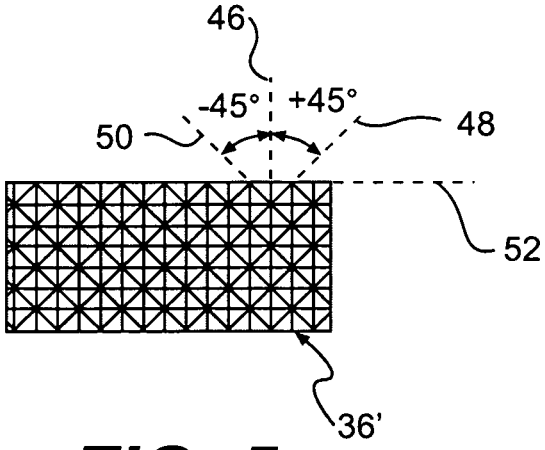
FIG. 5 illustrates a 0°/45° ceramic composite armor layer.

As can be appreciated, other orientations among the sublayers 38 may be used. FIG. 5 illustrates another example in which the unidirectionally oriented fibers 36' of one of the sublayers 38 are oriented in a 0° orientation as represented by axis 46, unidirectionally oriented fibers 36' of another sublayer 38 are oriented at a +45° orientation as represented by axis 48 relative to the 0° orientation 46, unidirectionally oriented fibers 36' of another sublayer 38 are oriented at a −45° orientation as represented by axis 50 relative to the 0° orientation 46, and unidirectionally oriented fibers 36' of another sublayer 38 are oriented at a 90° orientation as represented by axis 52 relative to the 0° orientation 46 (overall, a 0°/+45°/−45°/90° arrangement). Given this description, one of ordinary skill in the art will be able to recognize other orientations among the sublayers 38 to meet their particular needs.

Figure 6:
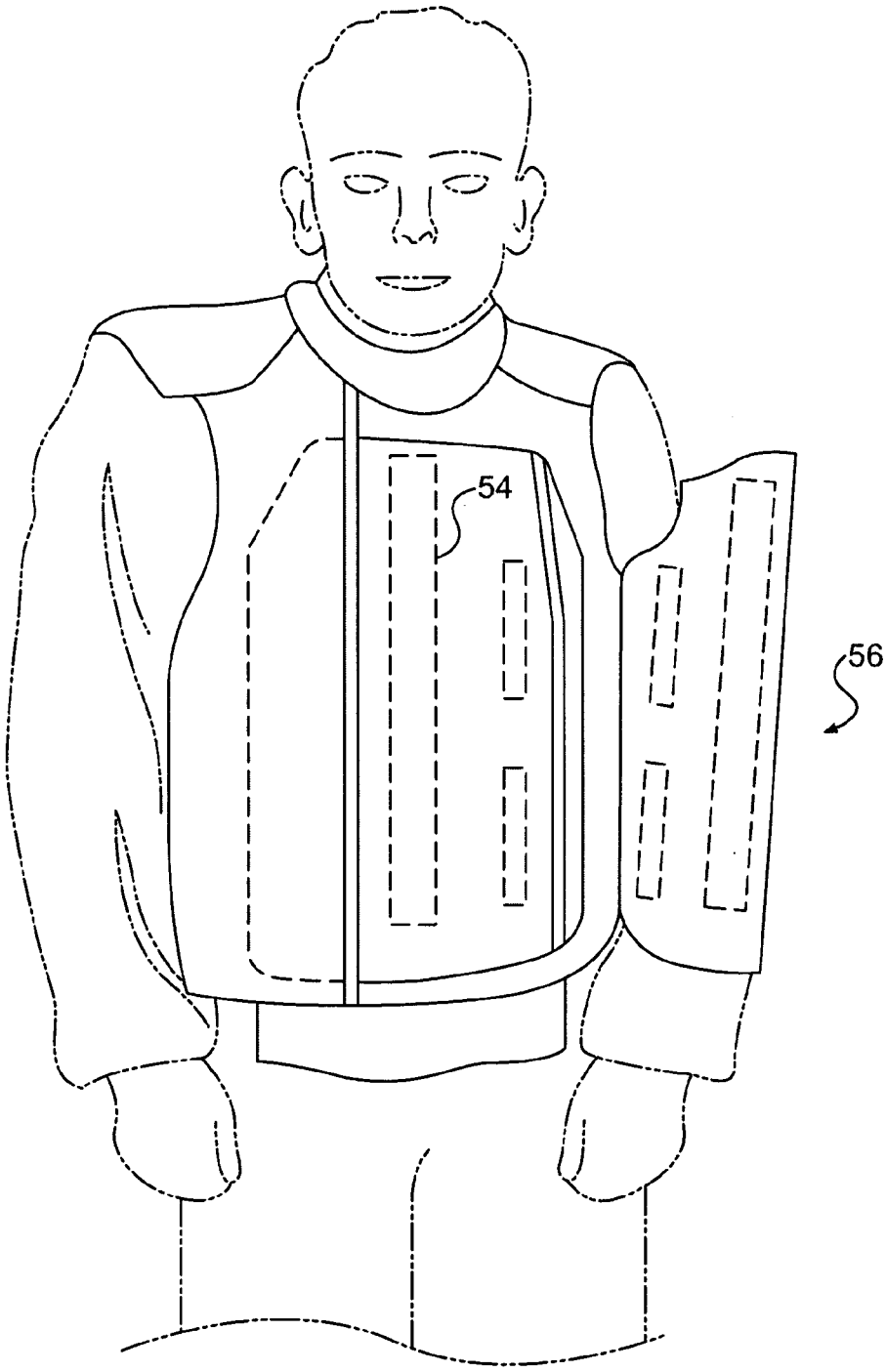
FIG. 6 illustrates armored panels utilized within an armor vest.

Referring to FIG. 6, the armor system 10 or 10' may be formed into panels 54 that are located within an armored vest 56. The panels 54 may be configured as small arms protective inserts (SAPI), which are removably retained at the front and the back of the armored vest 56. However, it is to be understood that the panels 54 may be sized to fit within current personal body armor system such as the interceptor body armor system. Additionally, the panels 54 may be adapted for use in other wearable armor systems for protecting an individual's side, neck, throat, shoulder, or groin areas.

Figure 7:
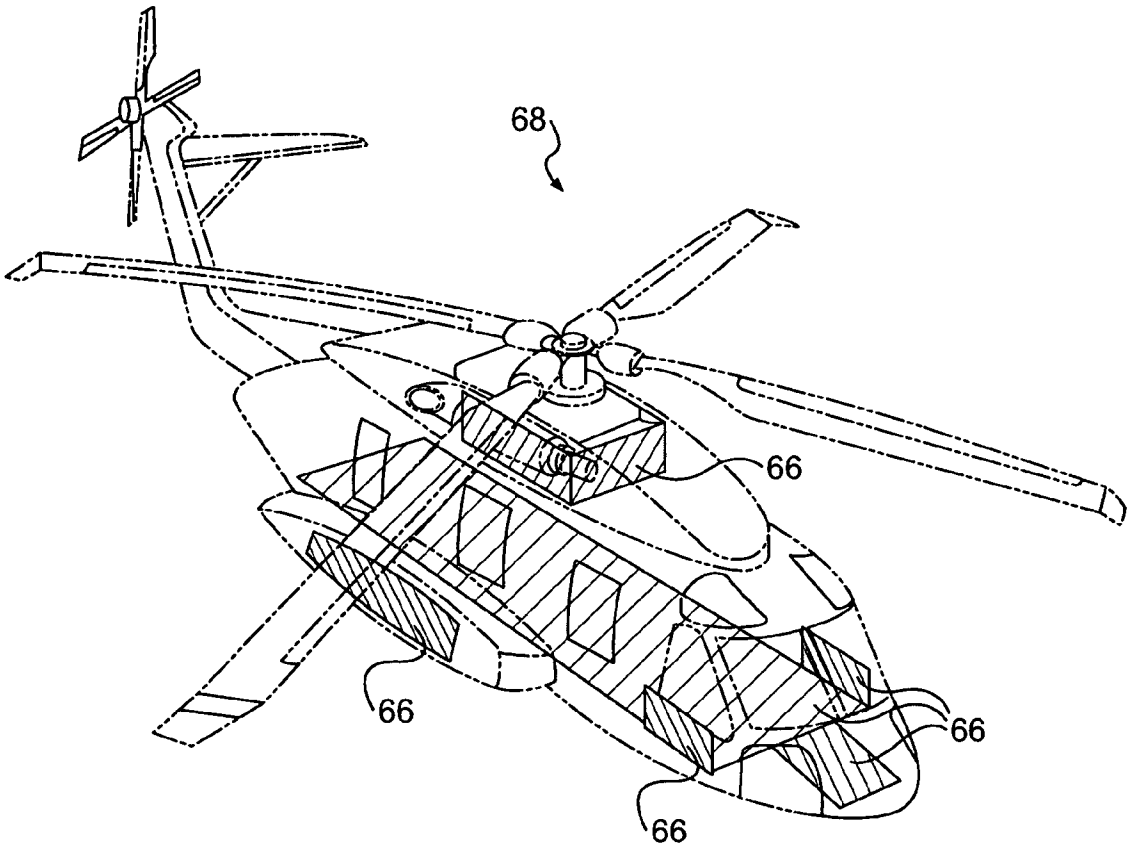
FIG. 7 illustrates armored panels utilized within an armor vehicle.

Referring to FIG. 7, the armor system 10 or 10' is formed into panels 66 that are utilized in a vehicle 68, such as a helicopter. It is to be understood that the panels 66 may also be used in other types of vehicles, such as ground vehicles, sea vehicles, air vehicles, or the like. In this example, the vehicle 68 includes a plurality of the panels 66 applied to provide a ballistic protection system (BPS), which may include add-on or integral armor to protect the vehicle. That is, the plurality of panels 66 may be attached over or included within structures of the vehicle, such as doors, floors, walls, engine panels, fuel tank areas, or the like but need not be integrated into the vehicle structure itself. As can be appreciated, the panels 66 may also be directly integrated into a vehicle load-bearing structure, such as an aircraft skin or other structures to provide ballistic protection. With the integration of the panels 66 into the vehicle structure itself, the ballistic protection of the occupants and crew is provided while the total weight of the armor structure system may be reduced as compared to parasitic armor systems.

Figure 8:
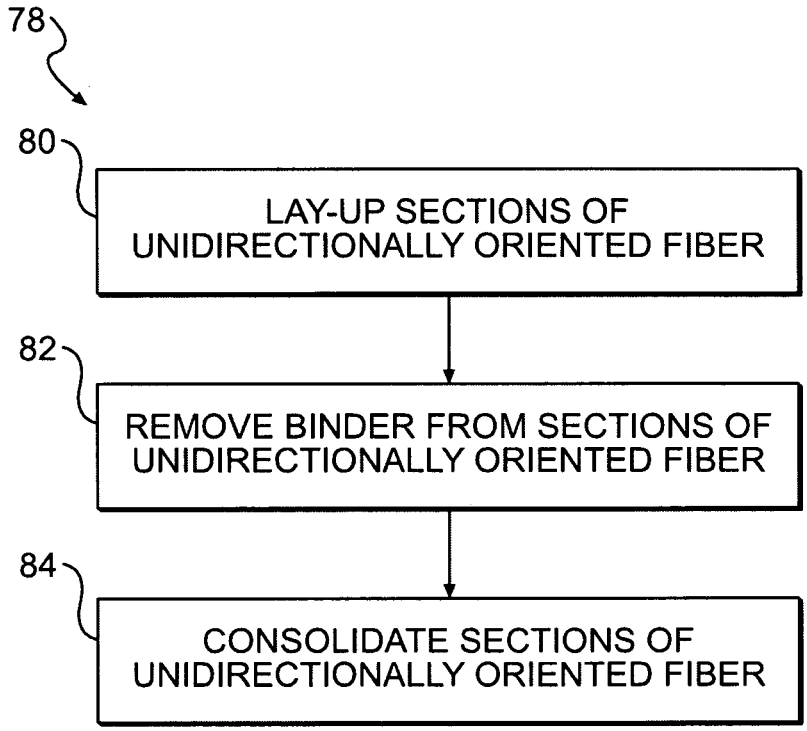
FIG. 8 illustrates an example method for manufacturing an armor system.

FIG. 8 illustrates one example method for manufacturing the armor system 10 or 10' into the shape of the panels 54 or 66 disclosed herein, or into other desired shapes. The manufacturing method 78 generally includes forming the ceramic composite armor layer 14 or 14' using pre-impregnated unidirectionally oriented tape, although the disclosed armor systems 10 and 10' are not limited to this manufacturing process and may be manufactured using other techniques.

The pre-impregnated unidirectionally oriented tape includes unidirectionally oriented fibers 36 or 36' that are disposed within a ceramic matrix 34 or 34' before consolidation. That is, the ceramic matrix 34 or 34' includes ceramic particles of the material selected for use as the ceramic matrix 34 or 34' suspended in a binder, such as a polymeric binder.

The tape may be prepared from a slurry of the ceramic particles in a carrier fluid, such as a solvent, and infiltrated into a fiber tow of the unidirectionally oriented fibers 36 or 36'. The infiltrated unidirectionally oriented fibers 36 or 36' may then be dried to remove the carrier fluid from the slurry and thereby produce the pre-impregnated unidirectionally oriented tape.

Subsequently, the tape may be cut into sections and, in lay-up action 80, stacked with a desired orientation of the unidirectionally oriented fibers 36'. For the ceramic composite armor layer 14 that utilizes only a single layer, only a single ply of the tape would be used. In a removal action 82, the binder is removed from the ceramic particles, such as by heating the tape at predetermined temperatures for predetermined amounts of time. The remaining green state composite is then consolidated in a consolidation action 84 at a predetermined temperature for a predetermined amount of time to produce the ceramic composite armor layer 14 or 14'.

In the disclosed embodiment, the ceramic composite armor layer 14 or 14' is consolidated or otherwise formed directly on the ceramic armor layer 12, which is pre-fabricated in a prior process. Forming the ceramic composite armor layer 14 or 14' directly on the ceramic armor layer 12 facilitates providing a strong bond between the ceramic armor layer 12 and the matrix 34 or 34' of the ceramic composite armor layer 14 or 14'. The relatively strong bonding may facilitate reflection of the stress waves and absorption of energy as discussed above. For example, the ceramic matrix 34 or 34' may chemically bond to the ceramic monolithic material of the ceramic armor layer 12. However, it is to be understood that any chemical bonding that may occur is not fully understood and may also comprise other reactions or mechanical interactions between the ceramic materials. In some examples, the consolidation action 84 of the example manufacturing method 78 may include other actions as disclosed in co-pending application Ser. No. 12/039,851.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An armor system comprising:

a ceramic armor layer including a strike face and an opposed, back face; and a ceramic composite armor layer including a front face and a rear face, the front face being directly bonded to the back face of the ceramic armor layer and free of any adhesive material therebetween, the ceramic composite armor layer comprising a matrix having a ceramic structure and unidirectionally oriented fibers embedded within the ceramic structure, wherein the ceramic armor layer and the ceramic composite armor layer each have an impedance of 15-40 x $10^6$ kilograms per square meter seconds (kg-$m^{-2}$–$s^{-1}$) such that an impact between a projectile and the strike face causes compressive stress waves to move through the ceramic armor layer toward the back face, at least a portion of the compressive stress wave reflecting off of a front face of the ceramic composite armor layer as a tensile stress wave and a second portion of the compressive stress wave travelling through the ceramic composite armor layer and reflecting off of a rear face of the ceramic composite armor layer, the tensile stress waves destructively interfering with the compressive stress waves, reducing the total stress within at least the ceramic armor layer.

2. The armor system as recited in claim 1, wherein the ceramic composite armor layer consists essentially of a monolithic ceramic material.

3. The armor system as recited in claim 1, wherein the unidirectionally oriented fibers are located within a plurality of sublayers of the ceramic composite armor layer, and at least one of the plurality of sublayers includes unidirectionally oriented fibers having a different orientation than the unidirectionally oriented fibers of another of the plurality of sublayers.

4. The armor system as recited in claim 1, wherein the ceramic armor layer and the ceramic composite armor layer are disposed within an armor panel that is located in at least one of an armored vest or a vehicle.

5. The armor system as recited in claim 1, wherein the ceramic armor layer and the ceramic composite armor layer each have an impedance of 25-30 ×$10^6$ kilograms per square meter seconds (kg-$m^{-2}$- $s^{-1}$).

6. The armor system as recited in claim 1, wherein the ceramic armor layer is a monolithic ceramic of silicon nitride.

7. The armor system as recited in claim 1, wherein the ceramic armor layer is a monolithic ceramic of silicon aluminum oxynitride.

8. The armor system as recited in claim 1, wherein the ceramic armor layer is a monolithic ceramic of aluminum nitride.

9. The armor system as recited in claim 1, wherein the ceramic armor layer is a monolithic ceramic of hafnium oxide.

10. The armor system as recited in claim 1, wherein the ceramic matrix comprises a silicate glass matrix or a glass-ceramic matrix, and the unidirectionally oriented fibers comprise silicon nitride fibers.

11. The armor system recited in claim 1, wherein the ceramic structure comprises a silicate glass structure or a glass-ceramic structure, and the unidirectionally oriented fibers comprise aluminum oxide fibers.

12. The armor system recited in claim 1, wherein the ceramic matrix comprises a silicate glass matrix or a glass-ceramic matrix, and the unidirectionally oriented fibers comprise aluminum oxynitride fibers.

13. The armor system recited in claim 1, wherein the ceramic matrix comprises a silicate glass matrix or a glass-ceramic matrix, and the unidirectionally oriented fibers comprise aluminum nitride fibers.

14. The armor system recited in claim 1, wherein the ceramic structure is a silicate glass structure or a glass-ceramic structure, and the unidirectionally oriented fibers are aluminum oxide fibers.

15. The armor system as recited in claim 1,wherein the ceramic armor layer is a monolithic ceramic of silicon aluminum oxynitride, the ceramic structure is a silicate glass structure or a glass-ceramic structure, and the unidirectionally oriented fibers are aluminum oxide fibers.

* * * * *